US011065895B2

(12) United States Patent
Saiga

(10) Patent No.: US 11,065,895 B2
(45) Date of Patent: Jul. 20, 2021

(54) LIQUID DISCHARGE DEVICE AND LIQUID DISCHARGE APPARATUS

(71) Applicant: Soichi Saiga, Tokyo (JP)

(72) Inventor: Soichi Saiga, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/875,253

(22) Filed: May 15, 2020

(65) Prior Publication Data

US 2021/0001651 A1 Jan. 7, 2021

(30) Foreign Application Priority Data

Jul. 4, 2019 (JP) ..... JP2019-125209

(51) Int. Cl.

| | |
|---|---|
| ***B41J 25/34*** | (2006.01) |
| ***B41J 2/15*** | (2006.01) |
| ***B41J 25/316*** | (2006.01) |
| *B41J 25/308* | (2006.01) |

(52) U.S. Cl.

CPC ..... *B41J 25/34* (2013.01); *B41J 2/15* (2013.01); *B41J 25/316* (2013.01); *B41J 25/3082* (2013.01); *B41J 25/3084* (2013.01); *B41J 25/3086* (2013.01)

(58) Field of Classification Search

CPC ... B41J 25/34; B41J 25/316; B41J 2/15; B41J 25/3086; B41J 25/3084; B41J 25/3082

See application file for complete search history.

(56) References Cited

U.S. PATENT DOCUMENTS

| | | | |
|---|---|---|---|
| 2010/0231643 | A1 | 9/2010 | Saiga et al. |
| 2010/0295897 | A1 | 11/2010 | Naruse et al. |
| 2011/0134187 | A1 | 6/2011 | Naruse et al. |
| 2011/0134190 | A1 | 6/2011 | Mase et al. |
| 2011/0141192 | A1 | 6/2011 | Komuro et al. |
| 2011/0199410 | A1 | 8/2011 | Mase et al. |
| 2011/0205299 | A1 | 8/2011 | Naruse et al. |
| 2011/0216113 | A1 | 9/2011 | Yorimoto et al. |
| 2012/0056936 | A1 | 3/2012 | Shimizu et al. |

(Continued)

FOREIGN PATENT DOCUMENTS

| | | |
|---|---|---|
| JP | 2016-087873 | 5/2016 |
| JP | 2018-183977 | 11/2018 |

*Primary Examiner* — Henok D Legesse

(74) *Attorney, Agent, or Firm* — Oblon, McClelland, Maier & Neustadt, L.L.P.

(57) ABSTRACT

A liquid discharge device includes a liquid discharge head to discharge a liquid, a head holder to hold the liquid discharge head, a sub-carriage to hold the head holder, a carriage to hold the sub-carriage and move in a main scanning direction, an adjuster supported by the sub-carriage, and a guide to guide the sub-carriage to be movable in a vertical direction. The carriage includes a reference shaft extending in the main scanning direction, the reference shaft supports the sub-carriage via the adjuster and positions the sub-carriage in the vertical direction, the adjuster adjusts an inclination of the sub-carriage with respect to the reference shaft, the sub-carriage includes a sub-reference shaft extending in parallel with the reference shaft, and the guide allows the sub-reference shaft to move in the vertical direction while restricting a movement of the sub-reference shaft in a sub-scanning direction perpendicular to the main scanning direction.

12 Claims, 8 Drawing Sheets

(56) References Cited

U.S. PATENT DOCUMENTS

| | | | | |
|---|---|---|---|---|
| 2012/0062649 | A1 | 3/2012 | Naruse et al. | |
| 2013/0034376 | A1 | 2/2013 | Saiga | |
| 2014/0063123 | A1* | 3/2014 | Saiga | B41J 2/17553 347/37 |
| 2016/0121634 | A1* | 5/2016 | Saiga | B41J 25/316 347/37 |
| 2016/0297212 | A1 | 10/2016 | Saiga et al. | |
| 2018/0311983 | A1* | 11/2018 | Saiga | B41J 25/316 |

* cited by examiner

LIQUID DISCHARGE DEVICE AND LIQUID DISCHARGE APPARATUS

CROSS-REFERENCE TO RELATED APPLICATION

This patent application is based on and claims priority pursuant to 35 U.S.C. § 119(a) to Japanese Patent Application No. 2019-125209, filed on Jul. 4, 2019, in the Japan Patent Office, the entire disclosure of which is hereby incorporated by reference herein.

BACKGROUND

Technical Field

Aspects of the present disclosure relate to a liquid discharge device and a liquid discharge apparatus.

Related Art

An image forming apparatus of liquid discharge recording type (inkjet recording apparatus) is used as an image forming apparatus such as a printer, a facsimile, a copy device, a plotter, a multifunction peripheral, for example. The inkjet recording apparatus includes a liquid discharge head to discharge a liquid as a recording head.

An image formed by the image forming apparatus of a liquid discharge recording type is greatly influenced by landing accuracy of the liquid discharged from nozzles of the liquid discharge head. If the landing accuracy of the liquid is poor, the image quality is degraded. Therefore, the liquid discharge head (recording head) has to be positioned with high accuracy.

SUMMARY

In an aspect of this disclosure, a liquid discharge device includes a liquid discharge head to discharge a liquid, a head holder to hold the liquid discharge head, a sub-carriage to hold the head holder, a carriage to hold the sub-carriage and move in a main scanning direction, an adjuster supported by the sub-carriage, and a guide to guide the sub-carriage to be movable in a vertical direction. The carriage includes a reference shaft extending in the main scanning direction, the reference shaft supports the sub-carriage via the adjuster and positions the sub-carriage in the vertical direction, the adjuster adjusts an inclination of the sub-carriage with respect to the reference shaft, the sub-carriage includes a sub-reference shaft extending in parallel with the reference shaft, and the guide allows the sub-reference shaft to move in the vertical direction while restricting a movement of the sub-reference shaft in a sub-scanning direction perpendicular to the main scanning direction.

BRIEF DESCRIPTION OF THE SEVERAL VIEWS OF THE DRAWINGS

The aforementioned and other aspects, features, and advantages of the present disclosure will be better understood by reference to the following detailed description when considered in connection with the accompanying drawings, wherein.

Figure 1:
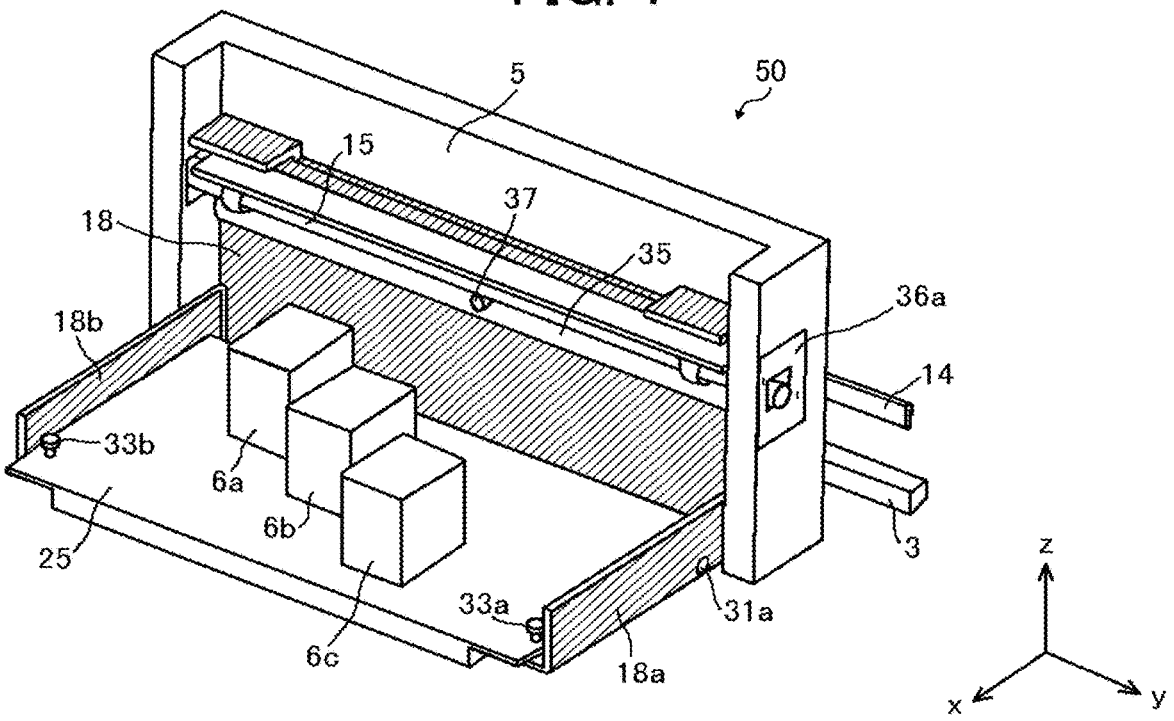
FIG. 1 is a schematic perspective view of a liquid discharge device according to a comparative example.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that have the same function, operate in a similar manner, and achieve similar results.

Although the embodiments are described with technical limitations with reference to the attached drawings, such description is not intended to limit the scope of the disclosure and all of the components or elements described in the embodiments of this disclosure are not necessarily indispensable. As used herein, the singular forms "a," "an," and "the" are intended to include the plural forms as well, unless the context clearly indicates otherwise.

Backgrounds are described below before describing an embodiments of the present disclosure to facilitate understanding of the present embodiments.

A liquid discharge apparatus can adjust an inclination of a head holder that holds a liquid discharge head on an actual machine. The inclination of the head holder relates to a degree of parallelism between the head holder and a platen. Hereinafter, a "liquid discharge head" and a "recording head" is simply referred to as a "head."

Comparative Example

FIG. 1 is a schematic perspective view of a liquid discharge device 50 according to a comparative example. As illustrated in FIG. 1, the liquid discharge device 50 includes a carriage 5 holding a head holder 25 via a sub-carriage 18. An XYZ Cartesian coordinate system is used below in FIGS. 1 through 9 with arrows X, Y, and Z for easier understanding of directions. In FIG. 1, a X-direction indicates a sub-scanning direction, and a Y-direction indicates a main scanning direction.

The head holder 25 mounts heads 6*a*, 6*b*, and 6*c* arranged in a staggered manner in a X-direction (sub-scanning direction). The heads 6*a*, 6*b* and 6*c* are simply referred to as "head 6" when the heads 6*a*, 6*b*, and 6*c* are not individually distinguished. A number of the heads 6 mounted on the head holder 25 may be one, two, or more than three.

The carriage 5 includes a reference shaft 15 extending in a direction identical to an extension direction of a guide rod 3 (Y-direction: main scanning direction). The liquid discharge device 50 includes a sub-carriage 18 detachably and rotatably mounted (hooked) on the reference shaft 15 via an adjuster 35. The sub-carriage 18 is held (positioned) in contact with the carriage 5 and is rotatable around a Y-axis in the Y-direction (rotatable in a roll direction) to contact with the carriage 5.

Figure 2:
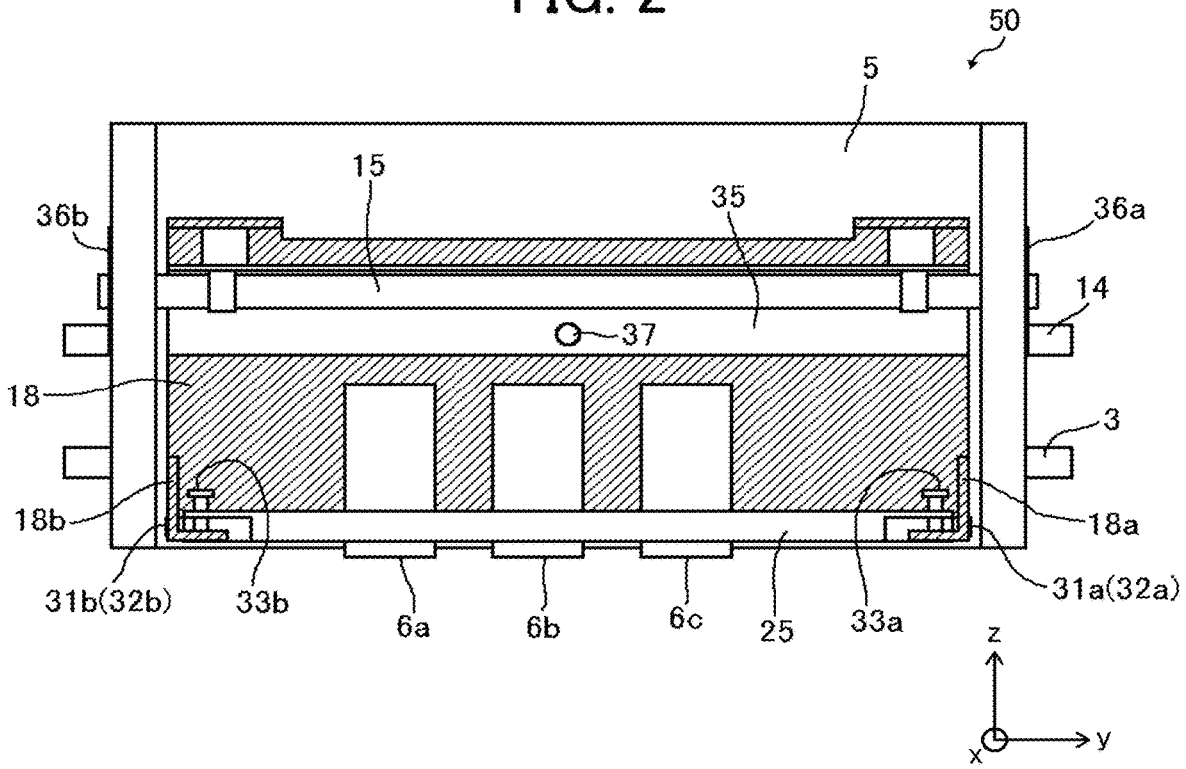
FIG. 2 is a schematic front view of the liquid discharge device of FIG. 1.

FIG. 2 is a schematic front view of the liquid discharge device 50 of FIG. 1. As illustrated in FIG. 2, the sub-carriage 18 rotatably supports the adjuster 35 around a sub-carriage rotation reference 37 serves as an X-axis in the X-direction (sub-scanning direction).

That is, the adjuster 35 is rotatable around the X-axis in the X-direction (rotatable in a pitch direction). The sub-carriage rotation reference 37 having a pin-shape is inserted into the sub-carriage 18 to fix the adjuster 35. Alternatively, the sub-carriage rotation reference as a step screw may be screwed into the sub-carriage 18.

Thus, the adjuster 35 is rotatable around the X-axis and can adjust an inclination of the sub-carriage (18) to the Y-direction (main scanning direction).

The sub-carriage 18 includes holding portions 18*a* and 18*b* at both ends of the head holder 25 to hold the head holder 25 (see FIG. 2). The sub-carriage 18 is detachably and rotatably hung on the reference shaft 15 via the adjuster 35, and the sub-carriage 18 holds the head holder 25. Thus, the sub-carriage 18 holds the head holder 25 so that the head holder 25 is rotatable around the reference shaft 15. That is, the head holder 25 is rotatable in a roll direction (tilt direction).

Thus, the liquid discharge device 50 includes the reference shaft 15 in a direction identical (parallel) to the guide rod 3 of the carriage 5. The reference shaft 15 parallel to the guide rod 3 can improve positional accuracy of inclination of the head 6 in the sub-scanning direction (X-direction), the height direction (Z-direction), a tilt direction (roll direction), and the main scanning direction (Y-direciton).

Further, the adjuster 35 is rotated around the sub-carriage rotation reference 37 to adjust inclination of the sub-carriage 18 with respect to the reference shaft 15. Therefore, the adjuster 35 can adjust the head 6 to be parallel with the printing surface in the X-direction (sub-scanning direction).

Figure 3:
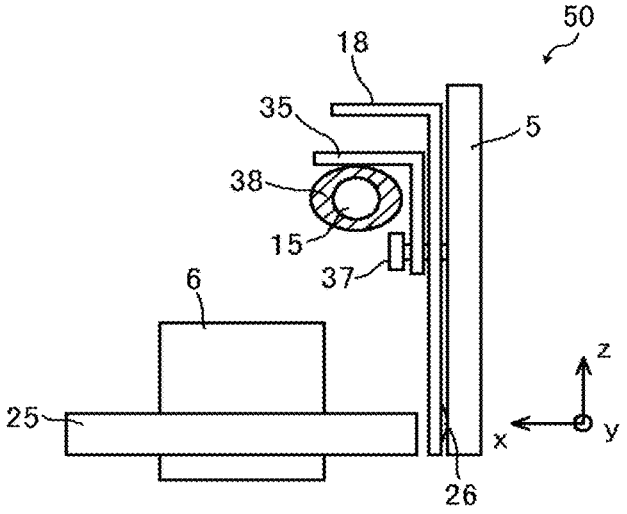
FIG. 3 is a schematic side view of the liquid discharge device of FIG. 1.

FIG. 3 is a schematic side view of the liquid discharge device 50 of FIG. 1.

As illustrated in FIG. 3, the liquid discharge device includes a cam 38 on the reference shaft 15. The cam 38 contacts the adjuster 35 and positions the sub-carriage 18 in a vertical direction (Z-direction). Thus, the cam 38 rotates to elevate the adjuster 35 to move (position) the sub-carriage 18 upward and downward so that a distance between the head 6 and a printing surface is changeable. Therefore, then cam 38 can adjust a height of the head 6 according to a thickness of a sheet.

As a method of rotating the cam 38, the cam 38 is fixed to the reference shaft 15, and the reference shaft 15 is rotated to rotate the cam 38. The reference shaft 15 may be rotated manually. Further, the liquid discharge device 50 may include a drive source to automatically rotate the reference shaft 15 to elevate the head 6 upward and downward. The above-described method enables an operation of elevation of the head 6 of the carriage 5 from outside the carriage 5.

The cam 38 elevates the head upward and downward so that the cam can desirably adjust a distance between the head 6 and the printing surface in an actual machine in accordance with a printing medium. Thus, the liquid discharge device 50 can increase types of print medium that can be printed (supported). The reference shaft 15 may be fixed to the carriage 5 via adjustment plates 36*a* and 36*b* that can adjust a position of the reference shaft 15 with respect to the carriage 5.

In the carriage 5 in which a head part (the head 6 and the head holder 25) that is elevatable with respect to the printing surface, the sub-carriage 18 is urged in a –X-direction by, for example, a spring member or the like, and comes into contact with the carriage 5 to be positioned in the carriage 5 (see FIG. 3). The head holder 25 includes an abutting portion 26 at one end of the head holder 25 that abuts against the carriage 5.

However, in such a configuration in which the head holder 25 abuts against the carriage 5 by an elastic body, the sub-carriage 18 easily rotates (vibrates) around the Y-axis (roll direction) when the carriage 5 is driven. Thus, a landing position of the discharged liquid may be displaced. In particular, if mass of the head part is large, a natural frequency decreases, and vibration tends to increase.

A rail extending in the vertical direction (Z-direction) may added to fix the movement of the sub-carriage 18 in the roll direction. However, if the rail in the vertical direction (Z-direction) is added to the liquid discharge device 50 illustrated in FIG. 2, the rail fixes a posture of the sub-carriage 18 in the pitch direction (around the X-axis, see FIG. 2). Thus, the rail may hinder a movement of the sub-carriage 18 in the vertical direction (Z-direction) and an adjustment of the inclination (rotation) of the sub-carriage 18 in the pitch direction (rotation in X-direction) at the same time.

Thus, in the following embodiments, a description is given below of a liquid discharge device 100 that can adjust a vertical position of the sub-carriage 18 and an inclination in a pitch direction and also fix the movement of the sub-carriage 18 in the roll direction.

First Embodiment

Figure 4:
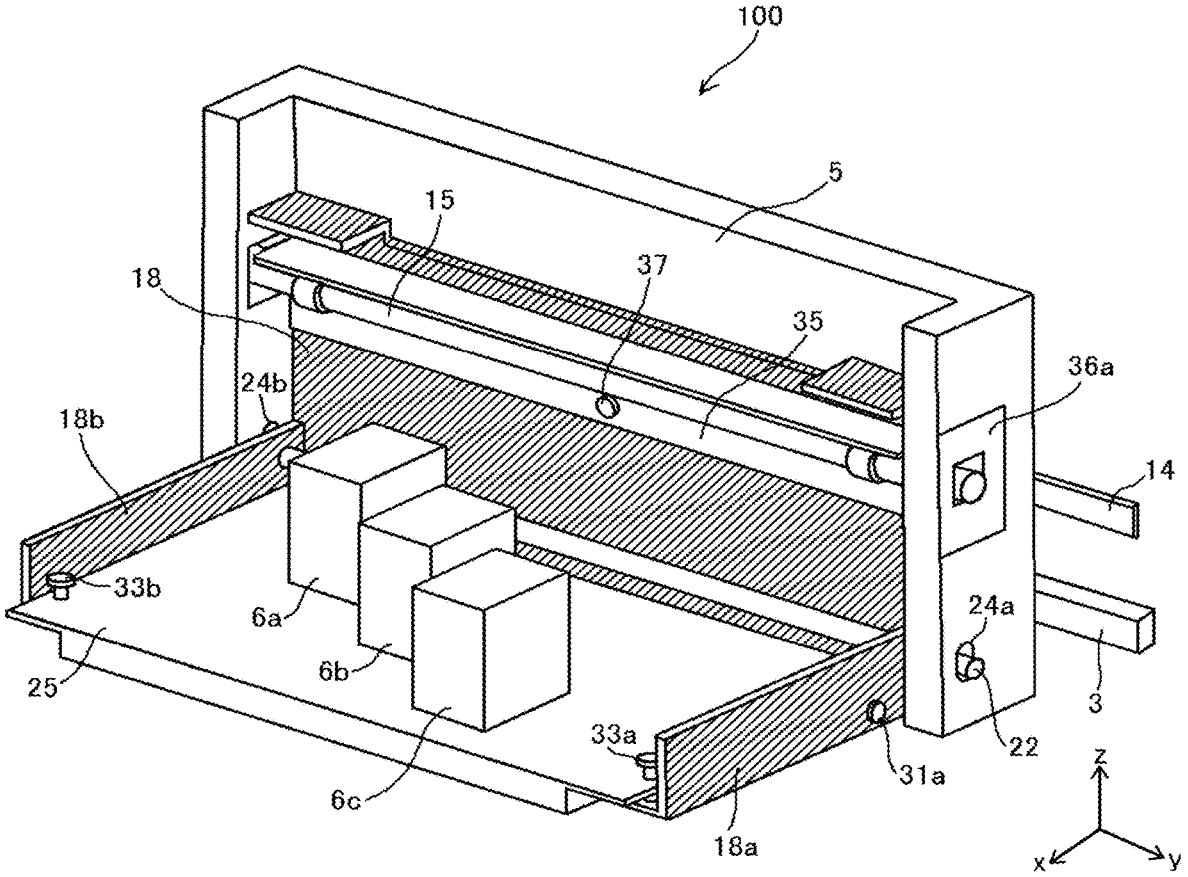
FIG. 4 is a schematic perspective view of a liquid discharge device according to a first embodiment of the present disclosure.

FIG. 4 is a schematic perspective view of a liquid discharge device 100 according to a first embodiment of the present disclosure. In FIG. 4, elements identical to the embodiments illustrated in FIG. 2 are given identical reference numerals, and the descriptions of the identical elements are omitted.

The liquid discharge device 100 illustrated in FIG. 4 includes a second reference shaft 22 at the holding portions 18*a* and 18*b* of the sub-carriage 18 in addition to the configuration illustrated in FIGS. 1 to 3. The second reference shaft 22 is a sub-reference shaft extending in parallel with the reference shaft 15 in the Y-direction (main scanning direction) while separating from the reference shaft 15. Both ends of the second reference shaft 22 are respectively inserted into through holes 24*a* and 24*b* that are receiving portions (guide) in the carriage 5.

The carriage 5 includes a guide includes the through holes 24*a* and 24*b* at both ends of the carriage 5 in the Y-direction (main scanning direction). The guide guides the sub-carriage 18 to move in the Z-direction (vertical direction). The guide (through holes 24*a* and 24*b*) allows the second reference shaft 22 (sub-reference shaft) to move in the Z-direction (vertical direction) while restricting a movement of the second reference shaft 22 (sub-reference shaft) in the X-direction (sub-scanning direction). Thus, the guides include the through holes 24*a* and 24*b* into which both ends of the second reference shaft 22 (sub-reference shaft) are respectively inserted.

Figure 5:
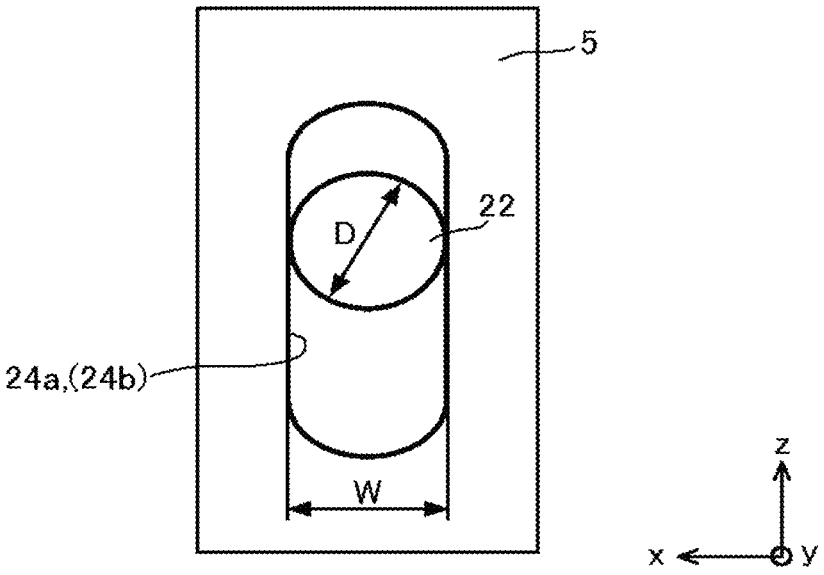
FIG. 5 is a schematic side view of a through hole and a second reference shaft according to the first embodiment of the present disclosure.

As illustrated in an enlarged side view of the carriage 5 in FIG. 5, each of the through holes 24*a* and 24*b* in the carriage 5 has a long-hole shape. Lengths (heights) of the through holes 24*a* and 24*b* in the Z-direction (vertical direction) are longer (larger) than a widths "W" of the through holes 24*a* and 24*b*, respectively in the X-direction (sub-scanning direction). The Z-direction (vertical direction) is a moving direction (elevating direction) of the sub-carriage 18.

Further, a width dimension (short diameter) "W" in a short direction (X-direction or sub-scanning direction) of the through holes 24*a* and 24*b* is substantially equal to an outer diameter "D" of the second reference shaft 22 (W D), that is, a so-called "clearance fit."

Therefore, the second reference shaft 22 can move in the Z-direction (vertical direction) and the Y-direction (main scanning direction) with respect to the through holes 24*a* and 24*b*. However, the movement of the second reference shaft 22 in the short direction (X-direction or sub-scanning direction) is restricted. The short direction is along the X-direction (sub-scanning direction).

Thus, the carriage 5 includes through holes 24*a* and 24*b* into which both ends of the second reference shaft 22 (sub-reference shaft) are inserted, respectively, and each of the through holes 24*a* and 24*b* has a long-hole shape long in the Z-direction (vertical direction) and restricts a movement of the second reference shaft 22 (sub-reference shaft) in the X-direction (sub-scanning direction).

In the first embodiment illustrated in FIG. 4, the sub-carriage 18 includes the second reference shaft 22, and the carriage 5 includes the through holes 24*a* and 24*b*. However, the present embodiments are not limited to the configuration as described above. As an alternative embodiment, the carriage 5 may include the second reference shaft 22, the sub-carriage 18 may include the through holes 24*a* and 24*b*, and the second reference shaft 22 may be inserted into the through holes 24*a* and 24*b* in the sub-carriage 18.

Figure 6A:
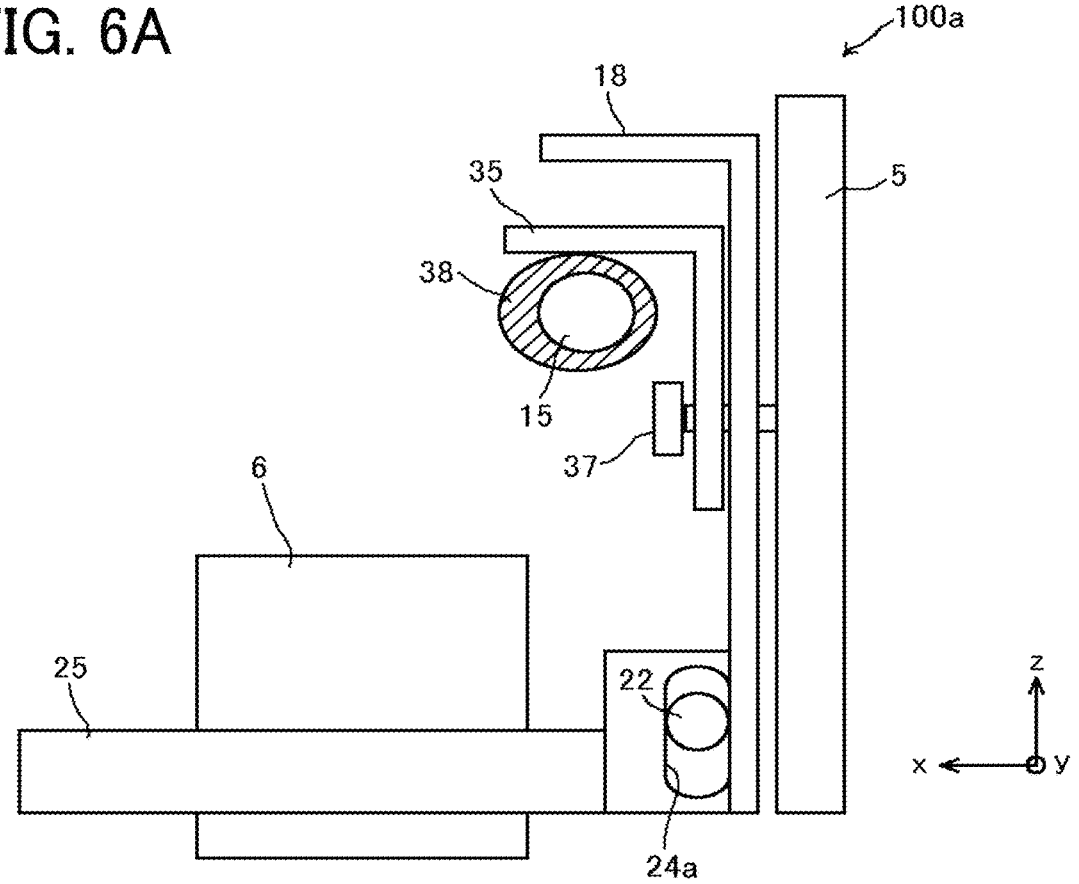
FIGS. 6A and 6B are schematic side views of the liquid discharge device according to the first embodiment of the present disclosure.
Figure 6B:
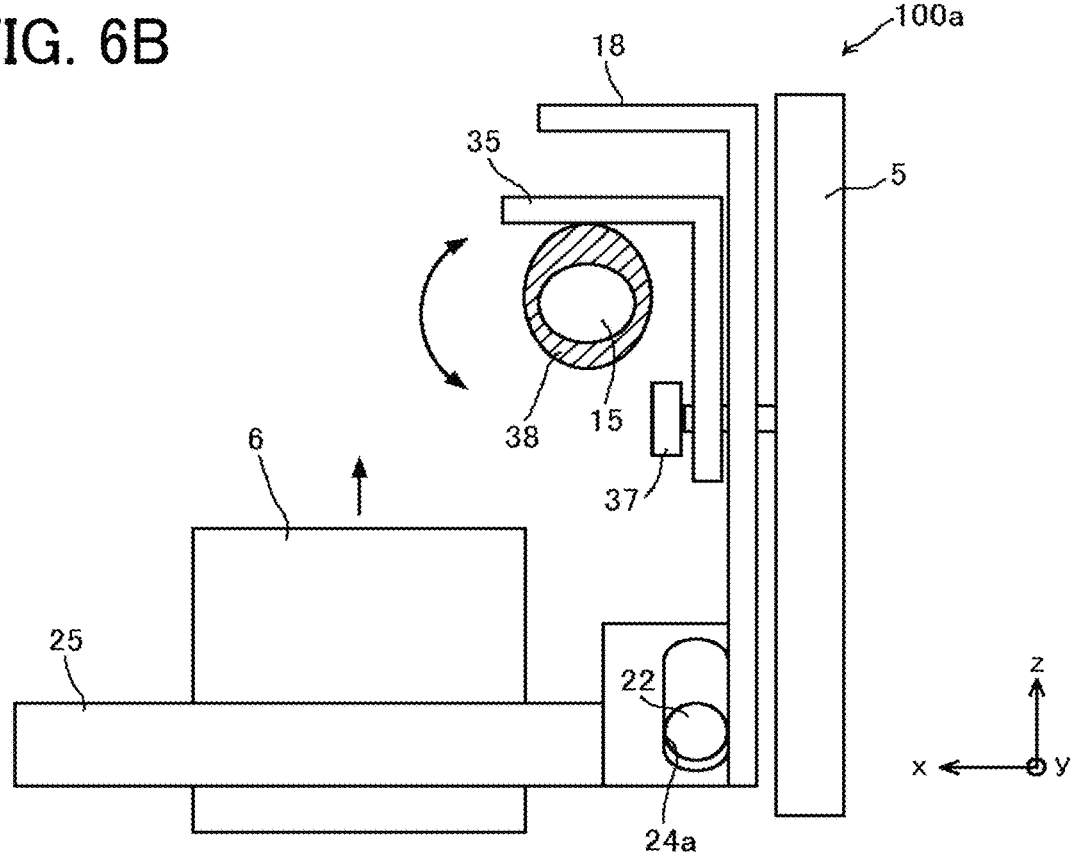

FIGS. 6A and 6B are schematic side views illustrating a liquid discharge device 100 of FIG. 4 according to the first embodiment of the present disclosure. FIG. 6A illustrates a state in which the head part is in a normal position. FIG. 6B illustrates a state in which the head part is in a raised (elevated) position. The liquid discharge device 100*a* illustrated in FIG. 6 includes a second reference shaft 22 in the carriage 5 inserted into a through hole 24*a* in the sub-carriage 18.

As illustrated in FIG. 6A, when the cam 38 contacts the adjuster 35 in a short diameter direction of the cam 38, the head part is at the normal position. Conversely, as illustrated in FIG. 6B, when the cam 38 rotates and contacts the adjuster 35 in a long diameter direction, the head part moves upward. Since each of the through holes 24*a* and 24*b* in the sub-carriage 18 has a long-hole shape having a long diameter in the Z-direction (vertical direction), the through holes 24*a* and 24*b* do not hinder the vertical movement of the second reference shaft 22.

Further, the second reference shaft 22 is also movable in the Y-Z direction (direction perpendicular to a sheet surface). Therefore, the adjuster 35 is rotatable about the sub-carriage rotation reference 37 around the X-axis in the X-direction (pitch direction). Further, the adjuster 35 supports the sub-carriage 18 at an angle with respect to the reference shaft 15.

As described above, the liquid discharge devices 100 and 100*a* according to the first embodiment restrict the rotation of the sub-carriage 18 in the roll direction while adjusting a movement of the sub-carriage 18 in the vertical direction (Z-direction) and a tilt (inclination) of the sub-carriage 18 in the pitch direction (rotation in X-direction). Therefore, the liquid discharge devices 100 and 100*a* according to the first embodiment can position the head 6 with high accuracy and can reduce vibration in the roll direction during driving (moving) of the carriage 5.

[Variation]

Figure 7:
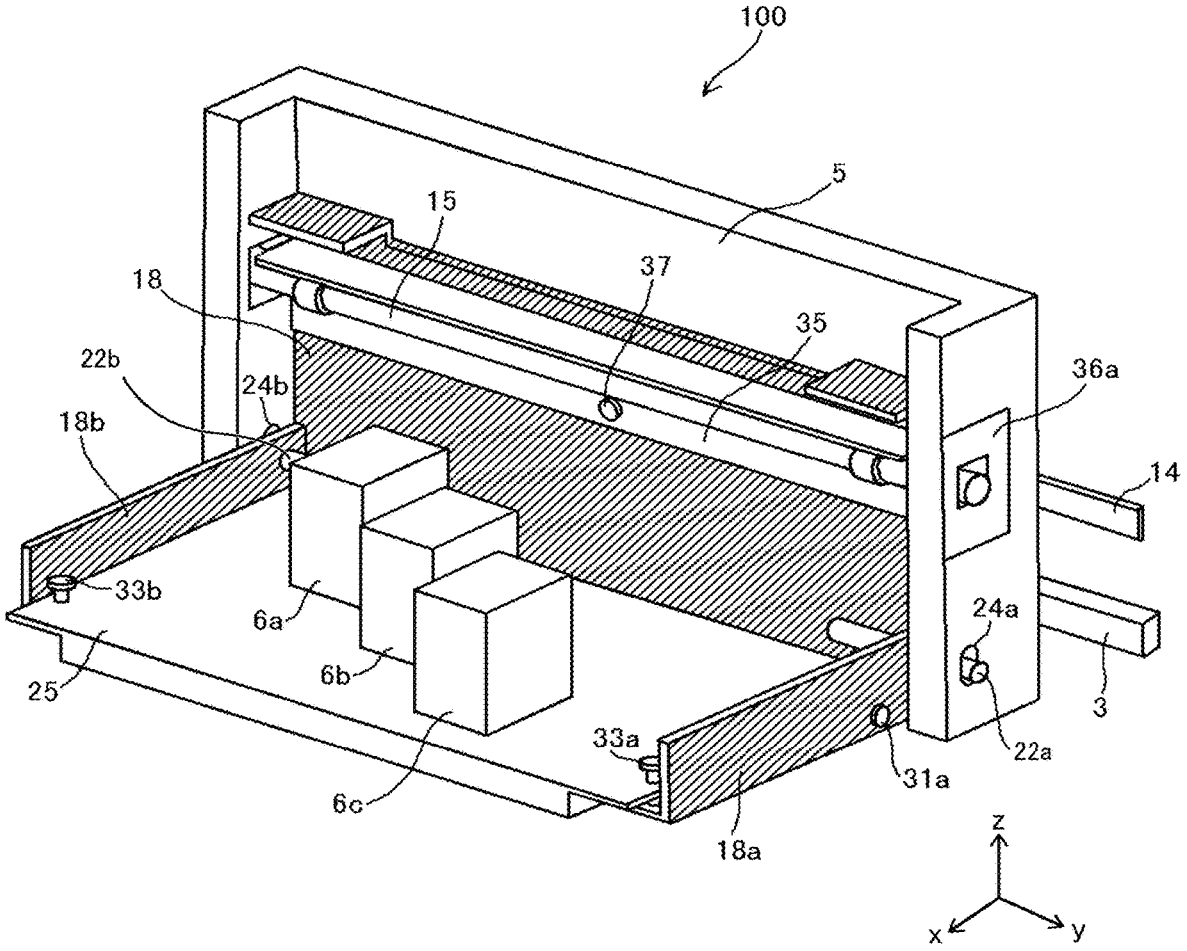
FIG. 7 is a schematic perspective view of the liquid discharge device according to a variation of the present disclosure.

FIG. 7 is a schematic perspective view of the liquid discharge device 100 according to a variation of the present disclosure. As illustrated in FIG. 7, the sub-carriage 18 may include two second reference shafts 22*a* and 22*b* (two sub-reference shafts). That is, the sub-carriage 18 may include the second reference shaft 22 illustrated in FIG. 4 that is divided into two on the same straight line to form two second reference shafts 22*a* and 22*b* (two sub-reference shafts). The two second reference shafts 22*a* and 22*b* are respectively inserted into the through holes 24*a* and 24*b*.

Thus, the liquid discharge device 100 in FIG. 7 expands a space above the head holder 25 so that the liquid discharge device 100 can increase a degree of freedom of arrangement of the heads 6 or reduce an area of the head holder 25.

Further, the two second reference shafts 22*a* and 22*b* may be step screws. Use of general standard stepped screws for the second reference shafts 22*a* and 22*b* can reduce a cost of parts.

Next, a configuration of another advantageous embodiment in the present disclosure is described below.

As illustrated in FIGS. 1, 2, 4, and 7, the head holder 25 includes rotation references 31*a* and 31*b* at both ends in the Y-direction (main scanning direction). Further, the head holder 25 includes the holding portions 18*a* and 18*b* at both ends of the head holder 25 in the Y-direction. Each of the holding portions 18*a* and 18*b* extends in the X-direction (sub-scanning direction). The holding portions 18*a* and 18*b* respectively include shaft holes 32*a* and 32*b* to rotatably support the rotation reference 31*a* and 31*b*.

Further, the head holder 25 includes adjustment screws 33*a* and 33*b* at both ends of the head holder 25 in the Y-direction (main scanning direction). Each of the adjustment screws 33*a* and 33*b* serves as an angle adjustment device that regulates rotation of the head holder 25 with respect to the sub-carriage 18 and adjusts a rotation angle between the head holder and the sub-carriage 18. The liquid discharge device 100 may include the rotation references 31*a* and 31*b* in the sub-carriage 18 and shaft holes 32*a* and 32*b* in the head holder 25.

Thus, the head holder 25 includes rotation references 31*a* and 31*b* along a Y-axis in the Y-direction (main scanning direction) around which the head holder 25 is rotatable with respect to the sub-carriage 18. The sub-carriage 18 includes shaft holes 32*a* and 32*b* to rotatably support the rotation references 31*a* and 31*b*, respectively. The head holder 25 includes an adjustment screws 33*a* and 33*b* (angle adjuster) to regulate rotation of the head holder 25 to adjust a rotation angle between the head holder 25 and the sub-carriage 18.

Further, the sub-carriage 18 may include rotation references 31*a* and 31*b* along the Y-axis in the main scanning direction around which the head holder 25 is rotatable with respect to the sub-carriage 18. The head holder 25 may include shaft holes 32*a* and 32*b* to rotatably support the rotation references 31*a* and 31*b*, respectively; and The sub-carriage 18 may include adjustment screws 33*a* and 33*b* (angle adjusters) to regulate rotation of the head holder 25 to adjust a rotation angle between the head holder 25 and the sub-carriage 18.

Figure 8:
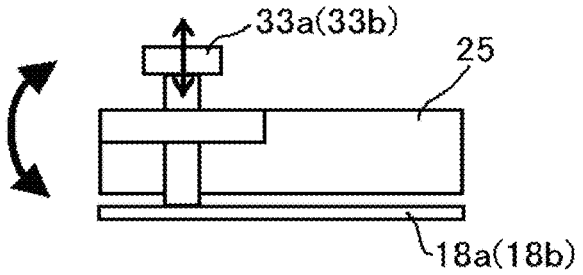
FIG. 8 is a partial enlarged side view of an adjustment screw of FIG. 7.

As illustrated in an enlarged side view in FIG. 8, the head holder 25 rotatably supports a thread of each of the adjustment screws 33*a* and 33*b*, for example. Further, the holding portions 18*a* and 18*b* of the sub-carriage 18 rotatably support tips of the adjustment screws 33*a* and 33*b*, respectively. Therefore, the adjustment screws 33*a* and 33*b* regulate the rotation of the head holder 25 with respect to the sub-carriage 18 (rotation of the head holder 25 around X-axis in the X-direction (main scanning direction)). Further, screwing the adjustment screws 33*a* and 33*b* can change a distance between the sub-carriage 18 and the head holder 25.

Figure 9A:
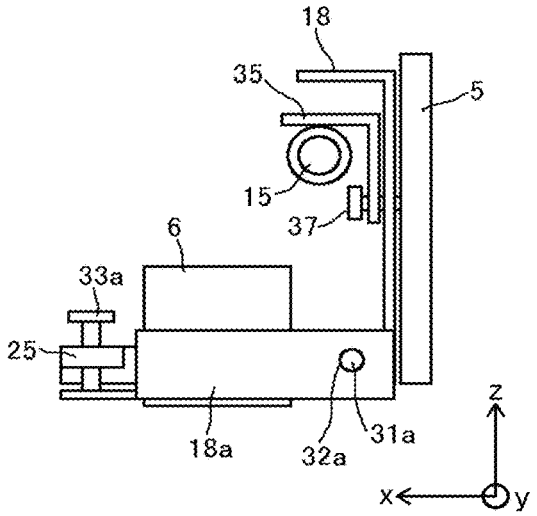
FIGS. 9A and 9B are schematic side views of the liquid discharge device according to the variation in the present disclosure.
Figure 9B:
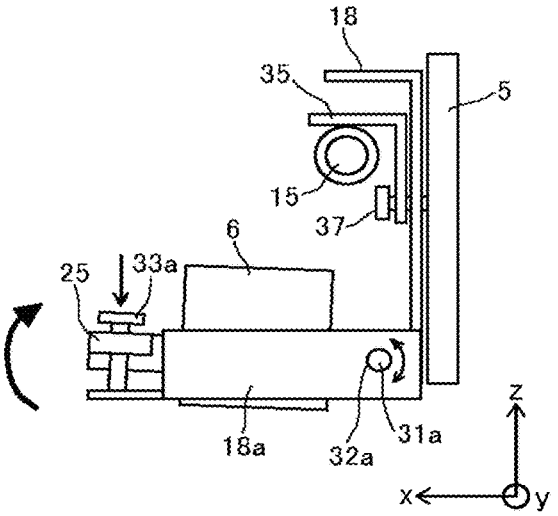

FIGS. 9A and 9B are schematic side views illustrating a liquid discharge device 100 of the variation in the present disclosure. FIG. 9A illustrates the liquid discharge device 100 before adjustment, and FIG. 9B illustrates the liquid discharge device 100 after adjustment. In FIGS. 9A and 9B, a part of the components is omitted for clarity.

As illustrated in FIGS. 9A and 9B, adjustment of amounts of tightening of the adjustment screws 33*a* and 33*b* can adjust a rotation angle between the head holder 25 and the sub-carriage 18 around the Y-axis in the Y-direction. Thus, adjustment screws 33*a* and 33*b* can adjust a height of the head holder 25 with respect to the sub-carriage 18 in the Z-direction (height direction).

That is, adjustment screws 33*a* and 33*b* can adjust the parallelism (rotation angle) between a nozzle surface of the head 6 and the printing surface (or a platen 7 described below) around the Y-axes in the Y-direction (main scanning direction). The adjustment screws 33*a* and 33*b* having finer screw pitch (thread pitch) can further highly accurately adjust the parallelism between the nozzle surface of the head 6 and the printing surface.

Further, as illustrated in FIGS. 1, 2, 4, and 7, the liquid discharge device 100 includes the adjustment screws 33*a* and 33*b* on both (left and right) sides of the head holder 25 so that the liquid discharge device 100 can change amounts of adjustment (tightening) of the adjustment screws 33*a* and 33*b* between the adjustment screw 33*a* (right side of head holder 25) and the adjustment screw 33*b* (left side of head holder 25). Thus, the liquid discharge device 100 can adjust the parallelism between the nozzle surface of the head 6 and the platen 7 (see FIG. 10) including at least one of a twist of the head holder 25 and a distortion of the sub-carriage 18.

Further, since the adjustment screws 33*a* and 33*b* regulate rotation of the head holder 25 around the rotation reference 31*a* and 31*b*, the liquid discharge device 100 can prevent the nozzle surface of the head 6 from contacting with the platen (see FIG. 10) by rotation of the head holder 25. Therefore, the liquid discharge device 100 can easily adjust the parallelism while actually measuring and confirming the parallelism on an actual machine without using a jig or the like.

As illustrated in FIGS. 1, 2, 4, and 7, the head holder 25 includes the rotation references 31*a* and 31*b*, and the sub-carriage 18 includes shaft holes 32*a* and 32*b*. Alternatively, the head holder 25 may include shaft holes 32*a* and 32*b*, and the sub-carriage 18 may include the rotation references 31*a* and 31*b*.

Further, the rotation references 31*a* and 31*b* may have a pin shape to be inserted into the holding portions 18*a* and 18*b*, respectively. Alternatively, the rotation references 31*a* and 31*b* may be step screws to be tightened into the holding portions 18*a* and 18*b*, respectively.

Further, the liquid discharge device 100 may include at least one of a fixing device to fix the sub-carriage 18 to the adjuster 35 and a fixing device to fix the sub-carriage 18 to the head holder 25.

Next, a general configuration and operation of a liquid discharge apparatus 1000 is described below.

Figure 10:
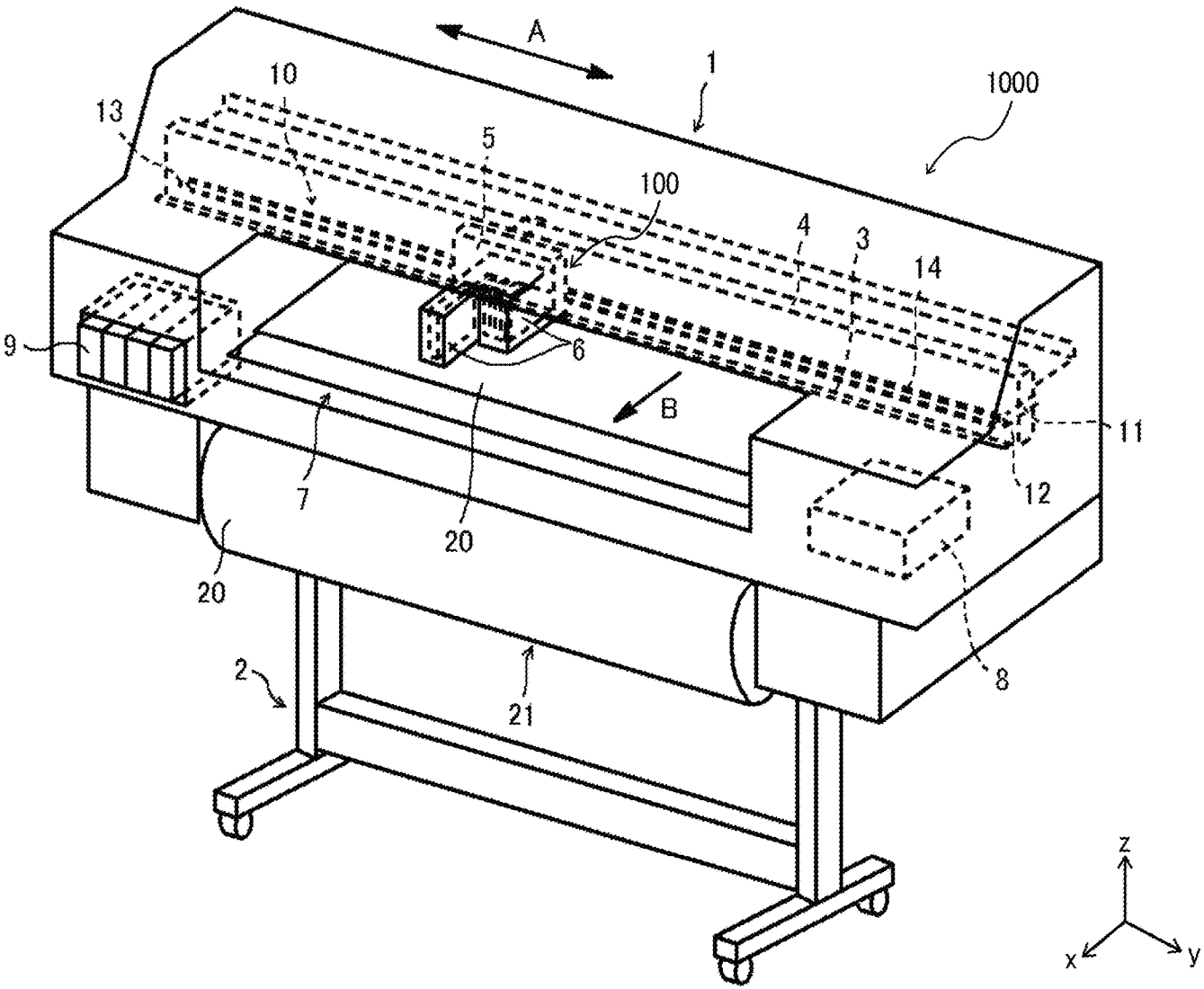
FIG. 10 is a schematic perspective view of a general structure of a liquid discharge apparatus according to an embodiment of the present disclosure.
Figure 11:
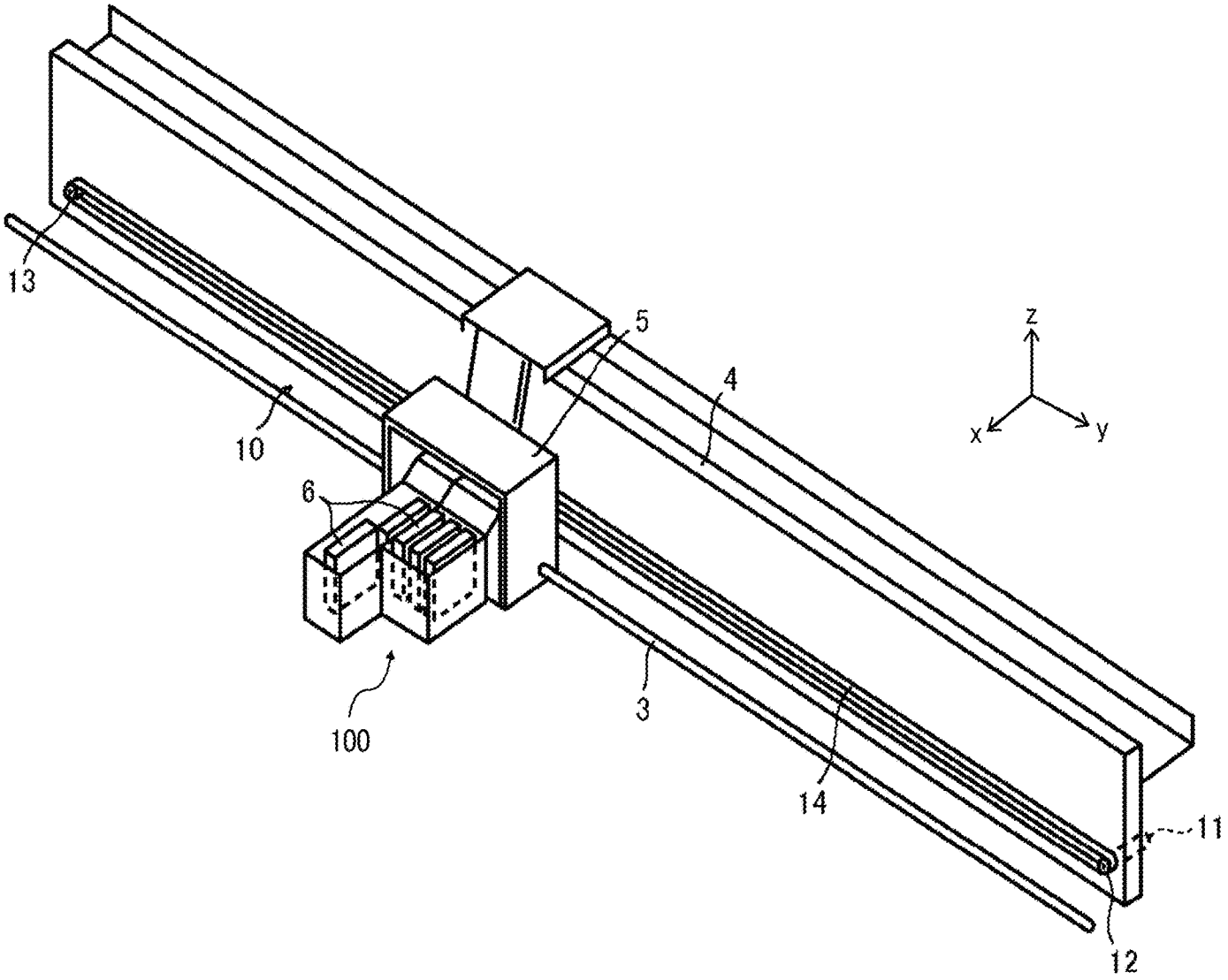
FIG. 11 is a partial enlarged schematic perspective view of a carriage scanner according to an embodiment of the present disclosure.

FIG. 10 is a schematic perspective view of a general structure of the liquid discharge apparatus 1000 according to an embodiment of the present disclosure. FIG. 11 is an enlarged schematic perspective view of a main scanner 10 (carriage scanner) according to the embodiment of the present disclosure.

As illustrated in FIG. 10, the liquid discharge apparatus 1000 is a serial-type inkjet recording apparatus. The liquid discharge apparatus 1000 includes apparatus body 1 and a support stand 2 that supports the apparatus body 1. The liquid discharge apparatus 1000 includes a guide rod 3 and a guide stay 4 serving as guides bridged over both side plates of the liquid discharge apparatus 1000. The guide rod 3 and the guide stay 4 movably support the carriage 5 in the Y-direction indicated by arrow "A" (main scanning direction).

The carriage 5 mounts heads 6 including liquid discharge heads that discharge liquids (inks) of respective colors of black (K), yellow (Y), magenta (M), and cyan (C). Each head 6 includes a plurality of nozzles to discharge a liquid. Each head 6 includes a head tank as a single unit. The head tank supplies ink to each head 6.

The liquid discharge apparatus 1000 includes the main scanner 10 to move and scan the carriage 5. The main scanner 10 includes a drive motor 11, a drive pulley 12, a driven pully 13, and a timing belt 14. The drive motor 11 is arranged on one side (right side in FIG. 10) of the main scanner 10 in the main scanning direction (Y-direction). The drive pulley 12 is rotatably driven by the drive motor 11. The driven pulley 13 is arranged on another side (left side in FIG. 10) of the main scanner 10 in the main scanning direction (Y-direction). The timing belt 14 is a traction member wound around the drive pulley 12 and a driven pulley 13. The driven pulley 13 is tensioned outward (in a direction away from the drive pulley 12) by a tension spring.

In a recording area in a main scanning area of the carriage 5, a sheet 20 is intermittently conveyed by a suction conveyor in the X-direction (sub-scanning direction) indicated by arrow "B" perpendicular to the Y-direction (main scanning direction) of the carriage 5. The recording area is an area in which the head 6 is dischargeable a liquid onto the sheet 20 to form an image on the sheet 20. The main scanning area is an area in which the carriage 5 moves and scans.

Further, the liquid discharge apparatus 1000 includes a maintenance device 8 to maintain and recover the head 6 in one end side area of the main scanning area of the carriage 5. The apparatus body 1 of the liquid discharge apparatus 1000 detachably attaches main cartridges 9 containing inks of respective colors to be supplied to the sub tank of the head 6.

The main cartridges 9 are attached to the apparatus body 1 outside the main scanning area (carriage moving area) in the Y-direction (main scanning direction), or in another end side area of the main scanning area opposite the end side area of the maintenance device 8. A roll sheet is set in a sheet feeder 21. Hereinafter, the roll sheet is simply referred to as the "sheet 20." However, the roll sheet having a different size in a width direction can be set in the sheet feeder 21.

The liquid discharge apparatus 1000 thus configured performs image formation as described below. First, the sheet 20 conveyed from the sheet feeder 21 is conveyed to the recording area by a conveyor from a rear side to a front side of the apparatus body 1 in the X-direction (sub-scanning direction) as indicated by arrow B in FIG. 10.

Next, the liquid discharge apparatus 1000 moves (scans) the carriage 5 in the Y-direction (main scanning direction) and drives the head 6 in accordance with image information to discharge liquids from the head 6 while intermittently conveys the sheet 20 to the platen 7 by the suction conveyor in the X-direction (sub-scanning direction) as indicated by arrow B in FIG. 10.

Thus, a desired image is formed on the sheet 20. Then, the sheet 20 after the image formation is cut into a predetermined length and is ejected to a discharge tray on the front side of the apparatus body 1.

The liquid discharge apparatus 1000 that cuts and ejects the sheet 20 is described above. However, the liquid discharge apparatus 1000 may wind the sheet by an ejection part without cutting the sheet 20 after image is formed on the sheet 20.

Next, clear definitions of terms used in the present embodiments are given below.

The term "liquid discharge head" used herein is a functional component to discharge or jet liquid from nozzles.

Further, "liquid" discharged from the head is not particularly limited as long as the liquid has a viscosity and surface tension of degrees dischargeable from the head. Preferably, the viscosity of the liquid is not greater than 30 mPa·s under ordinary temperature and ordinary pressure or by heating or cooling.

Examples of the liquid include a solution, a suspension, or an emulsion that contains, for example, a solvent, such as water or an organic solvent, a colorant, such as dye or pigment, a functional material, such as a polymerizable compound, a resin, or a surfactant, a biocompatible material, such as DNA, amino acid, protein, or calcium, or an edible material, such as a natural colorant.

Such a solution, a suspension, or an emulsion can be used for, e.g., inkjet ink, surface treatment solution, a liquid for forming components of electronic element or light-emitting element or a resist pattern of electronic circuit, or a material solution for three-dimensional fabrication.

Examples of an energy source (pressure generator) to generate energy to discharge liquid include a piezoelectric actuator (a laminated piezoelectric element or a thin-film piezoelectric element), a thermal actuator that employs a thermoelectric conversion element, such as a heating resistor, and an electrostatic actuator including a diaphragm and opposed electrodes.

The "liquid discharge device" is an assembly of parts relating to liquid discharge. The term "liquid discharge device" represents a structure including the head and a functional part(s) or mechanism combined to the head to form a single unit. For example, the "liquid discharge device" includes a combination of the head with at least one of a head tank, a carriage, a supply device, a maintenance device, and a main scan moving device to form a single unit.

Examples of the single unit include a combination in which the liquid discharge head and one or more functional parts and devices are secured to each other through, e.g., fastening, bonding, or engaging, and a combination in which one of the head and the functional parts and devices is movably held by another. The head may be detachably attached to the functional part(s) or device(s) each other.

For example, the head and the head tank may form the liquid discharge device as a single unit. Alternatively, the head and the head tank coupled (connected) with a tube or the like may form the liquid discharge device as a single unit. A device including a filter may be added at a position between the head tank and the head of the liquid discharge device.

In another example, the head and the carriage may form the liquid discharge device as a single unit.

In still another example, the liquid discharge device includes the head movably held by a guide that forms part of a main scan moving device, so that the head and the main scan moving device form a single unit. The liquid discharge device may include the head, the carriage, and the main scan moving device that form a single unit.

In still another example, a cap that forms part of a maintenance device may be secured to the carriage mounting the head so that the head, the carriage, and the maintenance device form a single unit to form the liquid discharge device.

Further, in another example, the liquid discharge device includes tubes connected to the head to which the head tank or the channel member is attached so that the head and a supply device form a single unit. Liquid is supplied from a liquid reservoir source to the head via the tube.

The main scan moving device may be a guide only. The supply device may be a tube(s) only or a loading device only.

The "liquid discharge apparatus" is a device that includes a liquid discharge head or a liquid discharge device and drives the liquid discharge head to discharge a liquid. The liquid discharge apparatus may be, for example, an apparatus capable of discharging liquid to a material onto which liquid can adhere and an apparatus to discharge liquid toward gas or into liquid.

The "liquid discharge apparatus" may include devices to feed, convey, and eject the material on which liquid can adhere. The liquid discharge apparatus may further include a pretreatment apparatus to coat a treatment liquid onto the material, and a post-treatment apparatus to coat a treatment liquid onto the material, onto which the liquid has been discharged.

The "liquid discharge apparatus" may be, for example, an image forming apparatus to form an image on a sheet by discharging ink, or a three-dimensional fabrication apparatus to discharge a fabrication liquid to a powder layer in which powder material is formed in layers to form a three-dimensional fabrication object.

The "liquid discharge apparatus" is not limited to an apparatus to discharge liquid to visualize meaningful images, such as letters or figures. For example, the liquid discharge apparatus may be an apparatus to form arbitrarily images, such as arbitrarily patterns, or fabricate three-dimensional images.

The above-described term "material onto which liquid can adhere" represents a material on which liquid is at least temporarily adhered, a material on which liquid is adhered and fixed, or a material into which liquid is adhered to permeate.

Examples of the "material onto which liquid can adhere" include recording media, such as paper sheet, recording paper, recording sheet of paper, film, and cloth, electronic component, such as electronic substrate and piezoelectric element, and media, such as powder layer, organ model, and testing cell. The "material onto which liquid can adhere" includes any material on which liquid is adhered, unless particularly limited.

Examples of the "material on which liquid can adhere" include any materials on which liquid can adhered even temporarily, such as paper, thread, fiber, fabric, leather, metal, plastic, glass, wood, ceramic, construction materials (e.g., wallpaper or floor material), and cloth textile.

The "liquid discharge apparatus" may be an apparatus to relatively move the head and a material on which liquid can be adhered. However, the liquid discharge apparatus is not limited to such an apparatus. For example, the liquid discharge apparatus may be a serial head apparatus that moves the head or a line head apparatus that does not move the head.

Examples of the "liquid discharge apparatus" further include a treatment liquid coating apparatus to discharge the treatment liquid to a sheet to coat the treatment liquid on a sheet surface to reform the sheet surface. Examples of the "liquid discharge apparatus" further include an injection granulation apparatus in which a composition liquid including raw materials dispersed in a solution is injected through nozzles to granulate fine particles of the raw materials.

Note that the term "sheet" is not limited to sheet of paper but represents a material to which ink droplets or other liquid can adhere. For example, the sheet may be an overhead projector (OHP) sheet, fabric, glass, or a substrate, and be used as a synonym of medium to be recorded, a recorded medium, a recording paper, or a recording sheet of paper. The terms "image formation", "recording", "printing", and "image printing" are used herein as synonyms for one another.

The term "ink" is not limited to "ink" in a narrow sense, unless specified, but is used as a generic term for any types of liquid usable as targets of image formation. For example, the term "ink" includes recording liquid, fixing solution, liquid, and the like. The "ink" may be, e.g., DNA sample, resist, pattern material, and the like.

The term "image" used herein is not limited to a two-dimensional image and includes, for example, an image applied to a three-dimensional object and a three-dimensional object itself formed as a three-dimensionally fabricated image.

The embodiments of the present disclosure have been described in detail above. Numerous additional modifications to the above-described embodiment and variations are possible. It is therefore to be understood that, within the scope of the appended claims, the disclosure of this patent specification may be practiced otherwise than as specifically described herein.

Numerous additional modifications and variations are possible in light of the above teachings. It is therefore to be understood that, within the scope of the above teachings, the present disclosure may be practiced otherwise than as specifically described herein. With some embodiments having thus been described, it is obvious that the same may be varied in many ways. Such variations are not to be regarded as a departure from the scope of the present disclosure and appended claims, and all such modifications are intended to be included within the scope of the present disclosure and appended claims.

What is claimed is:

1. A liquid discharge device comprising:

a liquid discharge head configured to discharge a liquid;

a head holder configured to hold the liquid discharge head;

a sub-carriage configured to hold the head holder;

a carriage configured to hold the sub-carriage and move in a main scanning direction;

an adjuster supported by the sub-carriage; and a guide configured to guide the sub-carriage to be movable in a vertical direction, wherein the carriage includes a reference shaft extending in the main scanning direction, the reference shaft supports the sub-carriage via the adjuster and positions the sub-carriage in the vertical direction, the adjuster adjusts an inclination of the sub-carriage with respect to the reference shaft, the sub-carriage includes a sub-reference shaft extending in parallel with the reference shaft, and the guide is configured to allow the sub-reference shaft to move in the vertical direction while restricting a movement of the sub-reference shaft in a sub-scanning direction perpendicular to the main scanning direction.

2. The liquid discharge device according to claim 1, wherein the guide includes through holes into which both ends of the sub-reference shaft in the main scanning direction are respectively inserted, and each of the through holes has a long-hole shape longer in the vertical direction than the sub-scanning direction to allow the sub-reference shaft to move in the vertical direction and restrict the movement of the sub-reference shaft in the sub-scanning direction.

3. The liquid discharge device according to claim 2, wherein the carriage includes the through holes at both ends of the carriage in the main scanning direction, the sub-carriage includes the sub-reference shaft, and the both ends of the sub-reference shaft are respectively inserted into the through holes in the carriage.

4. The liquid discharge device according to claim 2, wherein the carriage includes the sub-reference shaft, the sub-carriage includes the through holes at both ends of the sub-carriage in the main scanning direction, and the both ends of the sub-reference shaft are respectively inserted into the through holes in the sub-carriage.

5. The liquid discharge device according to claim 4, wherein a width of each of the through holes in the sub-scanning direction perpendicular to the vertical direction is equal to an outer diameter of the sub-reference shaft.

6. The liquid discharge device according to claim 2, wherein the sub-reference shaft is divided into two on a same straight line to form two sub-reference shafts, and the two sub-reference shafts are respectively inserted into the through holes of the guide.

7. The liquid discharge device according to claim 6, wherein the two sub-reference shafts are step screws.

8. The liquid discharge device according to claim 1, wherein the sub-carriage rotatably supports the adjuster around an axis in the sub-scanning direction.

9. The liquid discharge device according to claim 1, wherein the reference shaft includes a cam contacting the adjuster, and the cam is configured to elevate the adjuster to position the sub-carriage in the vertical direction.

10. The liquid discharge device according to claim 1, wherein the head holder includes rotation references configured to rotate the head holder around an axis in the main scanning direction with respect to the sub-carriage, the sub-carriage includes shaft holes to rotatably support the rotation references, respectively, and the head holder includes an angle adjuster configured to regulate rotation of the head holder to adjust a rotation angle between the head holder and the sub-carriage.

11. The liquid discharge device according to claim 1, wherein the sub-carriage includes rotation references configured to rotate the head holder around an axis in the main scanning direction with respect to the sub-carriage, the head holder includes shaft holes to rotatably support the rotation references, respectively, and the sub-carriage includes an angle adjuster configured to regulate rotation of the head holder to adjust a rotation angle between the head holder and the sub-carriage.

12. A liquid discharge apparatus comprising the liquid discharge device according to claim 1.

* * * * *